US005439179A

United States Patent [19]

Nolin et al.

[11] Patent Number: 5,439,179

[45] Date of Patent: Aug. 8, 1995

[54] METHOD AND APPARATUS FOR FRAGMENTING A BLOCK OF FROZEN VEGETABLE TISSUE

[75] Inventors: Richard Nolin, Repentigny; John Dery, Montreal, both of Canada

[73] Assignee: Johnson & Johnson Inc., Canada

[21] Appl. No.: 43,174

[22] Filed: Apr. 2, 1993

[30] Foreign Application Priority Data

Apr. 7, 1992 [CA] Canada ..... 2065506

[51] Int. Cl.[6] ..... B27K 9/00; B02C 1/06; B02C 1/10

[52] U.S. Cl. ..... 241/28; 241/37; 241/84.3; 241/265; 241/266

[58] Field of Search ..... 241/2, 15, 24, 28, 30, 241/32, 37, 65, 81, 84.3, 95, 264, 265, 266

[56] References Cited

U.S. PATENT DOCUMENTS

| | | | |
|---|---|---|---|
| 1,358,682 | 11/1920 | Rennerfelt | 241/32 |
| 3,010,663 | 11/1961 | Bosshard | 241/37 |
| 3,305,181 | 2/1967 | Barrot et al. | 241/37 |
| 4,363,448 | 12/1982 | Machler et al. | 241/37 |
| 4,406,412 | 9/1983 | Alexandersson | 241/37 |
| 4,903,900 | 2/1990 | Rousseau | 241/30 |
| 5,082,187 | 1/1992 | Kirchhoff et al. | 241/95 |
| 5,183,216 | 2/1993 | Wack | 241/266 |

FOREIGN PATENT DOCUMENTS

| | | | |
|---|---|---|---|
| 52589 | 5/1982 | European Pat. Off. | B02C 1/02 |
| 2337327 | 7/1973 | Germany | B02C 8/02 |
| 3520061 | 6/1985 | Germany | B02C 7/02 |
| 1042797 | 9/1983 | U.S.S.R. | B02C 1/02 |

OTHER PUBLICATIONS

LaBounty, "Grapples That Perform", Jan. 1990.
Telescreen, "Super Shredder", [no date given].
Dresser, "Flextooth Crushers", [no date given].
Shred-Tech Limited, product literature related to the Shred-Tech ST-100, Feb. 7, 1991.
Rawlings, "Rotary Hogs", Feb. 11, 1991.
"Frozen Coal Cracker" (product literature) [no date given].
Stamler Corporation, "Belt Feeder Breaker", (product drawings), Apr. 22, 1988.
Williams, "Hydraulic Shear Shredder", Feb. 7, 1991.
Denis, product literature on grapples, [no date given].
Norba, "Norba Crusher", [no date given].

*Primary Examiner*—Timothy V. Eley
*Attorney, Agent, or Firm*—James P. Barr

[57] ABSTRACT

An apparatus for fragmenting a block of frozen vegetable tissue such as peat moss, without causing widespread damage to the individual vegetable fibers, comprising a pair of planar jaw members movable between opened and closed positions. Each jaw member has a grating-like configuration defining a plurality of discharge apertures in a spaced apart relationship and also comprises projecting crushing teeth. In the closed position, the jaw members are in a mating relationship, whereby the crushing teeth of each jaw member deeply penetrate the discharge apertures of the opposite jaw member. In operation, a block of frozen vegetable tissue is loaded between the jaw members while they are in the opened position. The jaw members are closed for bursting into fragments the block of frozen vegetable tissue under the effect of multiple pressure points created by the crushing teeth on the block surface and for expelling the fragments through the discharge apertures. The invention also relates to a novel method for fragmenting a block of frozen vegetable tissue without causing wide-spread damage to the individual vegetable fibers.

29 Claims, 6 Drawing Sheets

METHOD AND APPARATUS FOR FRAGMENTING A BLOCK OF FROZEN VEGETABLE TISSUE

FIELD OF THE INVENTION

The present invention relates to the art of processing vegetable materials such as peat moss and, more particularly, to a method and apparatus for fragmenting a block of frozen vegetable tissue without causing wide-spread damage to the individual vegetable fibers.

BACKGROUND OF THE INVENTION

The prior art has recognized the potential of peat moss material for use as an absorbent medium in structures for absorbing body exudate, such as sanitary napkins. The peat moss material has highly desirable fluid absorption properties such as a remarkable absorption capacity and the ability of "drying" adjoining materials by continuing to pull or wick fluid away from them over a long time period such that virtually all the fluid is collected in the peat moss core. These attributes allow the material to provide highly efficient absorbent components which can be made relatively thin for better fit, comfort and discretion, while being sufficiently absorbent to prevent overflow leakage and garment staining.

The following United States Patents document the use of peat moss material for manufacturing absorbent components for disposable absorbent products:

| U.S. Pat. No. | INVENTORS | DATE ISSUED |
|---|---|---|
| 4,170,515 | Lalancette et al. | October 9, 1979 |
| 4,215,692 | Levesque | August 5, 1980 |
| 4,226,237 | Levesque | October 7, 1980 |
| 4,305,393 | Nguyen | December 15, 1981 |
| 4,473,440 | Ovans | September 25, 1984 |
| 4,507,122 | Levesque | March 26, 1985 |
| 4,618,496 | Brasseur | October 21, 1986 |
| 4,676,871 | Cadieux et al. | June 30, 1987 |
| 4,992,324 | Dubé | February 12, 1991 |
| 5,053,029 | Yang | October 1, 1991 |

The subject matter of these references is incorporated herein by reference.

Peat moss material can be formed in a highly cohesive board by using any one of the methods disclosed in the above-identified prior art. In a board form, the peat moss material is convenient to handle and it can be directly processed in high speed automatic equipment for assembling disposable absorbent products.

In broad terms, the method for producing the peat moss board consists of classifying raw peat moss material in particulate form to retain only the particles which are the most absorbent. The screened fraction is sheeted on a Fourdrinier wire in the form of a slurry and dewatered by the application of vacuum. The thus formed board is dried and calendered to increase its density to the desired level.

The raw vegetable material for manufacturing a peat moss board by the above-described method is harvested from a bog and baled into blocks having approximately a length of 1,20 meters, a width of 50 centimeters and a height of 50 centimeters. The blocks are transported to the processing site where they are defiberated and mixed with dilution water to form the slurry which is screened and delivered to the Fourdrinier wire.

A block of freshly harvested peat moss material has a very high water content, in the range from about 80% to about 95%. Accordingly, the block is prone to freezing if it is exposed to sub-zero temperatures for an appreciable amount of time. In practice, this may occur when the block of peat moss material is stored outdoors during the winter season.

When a block of peat moss freezes, it must be completely thawed before it can be further processed. One possibility is to immerse the block. of peat moss in warm dilution water which gently thaws the peat moss material without damaging in any way the peat moss fibers. However, the thawing operation is time-consuming primarily due to the substantial size of the frozen block, and also because the peat moss material has excellent thermal insulation characteristics retarding the heat transfer toward the core of the block.

Attempts to accelerate the thawing operation by using very hot dilution water have not met with success because the high water temperature risks to permanently damage the peat moss fibers and adversely affect their absorbency characteristics.

A possible solution is to mechanically reduce the block of frozen peat moss material into fragments, which would greatly accelerate the thawing operation by virtue of the increased contact surface between the warm dilution water and the frozen medium. However, it is critical to avoid a wide-spread damage at the fiber level when fragmenting the peat moss block to preserve unimpaired the absorbency characteristics of the peat moss material.

SUMMARY OF THE INVENTION

An object of the present invention is an apparatus for fragmenting a block of frozen vegetable tissue, such as peat moss, without causing wide-spread damage to the individual vegetable fibers.

Another object of the invention is a method for fragmenting a block of frozen vegetable tissue, such as peat moss, without causing wide-spread damage to the individual vegetable fibers.

As embodied and broadly described herein, the invention provides an apparatus for fragmenting a block of frozen vegetable tissue such as peat moss, without causing wide-spread damage to the vegetable tissue at the fiber level, comprising:

a crushing assembly including a pair of jaw members, each jaw member having a lattice-like configuration and including a plurality of elongated crossing members defining therebetween discharge apertures, the crushing assembly further including a plurality of projecting crushing teeth in a spaced apart relationship, the crushing assembly being movable between an opened position and a closed position, in the opened position the jaw members being in a spaced apart relationship for accepting therebetween a block of frozen vegetable tissue, in the closed position the jaw members being in a mating relationship wherein the projecting crushing teeth penetrate respective discharge apertures, movement of the crushing assembly from the opened to the closed position causes the crushing teeth to engage and reduce to fragments the block of frozen vegetable tissue which egress the crushing assembly through the discharge apertures; and actuating means in driving relationship with the crushing assembly for moving the crushing assembly between the opened and the closed positions.

The application of a multi-point pressure on the surface of the block of frozen peat moss material by the crushing teeth allows to cleanly crack the block and reduce it into smaller fragments without causing a wide-spread damage to the vegetable tissue at the fiber level. In other words, during the fragmentation, only a small number of individual fibers are damaged while the vast majority of the fibers remain intact.

In a preferred embodiment, each jaw member is constituted by an arrangement of massive crossing plates forming a planar grating and defining therebetween the discharge apertures which are distributed over the entire surface of the jaw member. The longitudinally extending plates of the grating have a jagged configuration to form the crushing teeth.

When the crushing assembly is closed and the jaw members are brought one against the other, the crushing teeth of one jaw member deeply penetrate into the discharge apertures of the opposite jaw member. The crushing teeth fulfil a dual function. Firstly, they apply the pressure on the surface of the block of frozen peat moss material in order to mechanically reduce the block into fragments. Secondly, the crushing teeth of one jaw member forcibly expel oversize fragments through the discharge apertures of the opposite jaw member, which are too large to freely fall through the discharge apertures under the effect of gravity. This self-cleaning feature is particularly advantageous when processing semi-frozen peat moss blocks because the resulting fragments are soft and have a sticky surface, thereby adhering to the crossing plates forming the jaw members. Without any provision to forcibly expel the sticky fragments through the discharge apertures they may agglomerate into a lumpy mass and possibly clog the apparatus.

The actuator for closing and opening the crushing assembly is preferably hydraulic piston-cylinder assemblies. However, it is within the scope of this invention to use other types of actuators such as pneumatic piston-cylinder assemblies or any suitable mechanical or electrical drive systems, among others.

In order to most effectively fragment the block of frozen peat moss material it is preferable that the stress points created on the surface of the block by the crushing teeth should be at a certain minimal distance for cleanly cracking the block into fragments which will easily separate from one another. It has been observed that if the crushing teeth are excessively close to one another, in some instances the block of frozen peat moss plastically deforms under the pressure applied by the closing jaw members, instead of bursting into individual fragments. As a result, the peat moss material is shredded by the crushing teeth which may cause significant and wide-spread damage to the individual fibers. In order to avoid this difficulty it is preferred that the number of crushing teeth per unit area of a jaw member does not substantially exceed 55 per square meter. Most preferably, each jaw member has approximately 12 teeth per square meter.

In a most preferred embodiment, the apparatus is provided with an overload controller to detect the presence of a non-crushable object such as a rock, a tree trunk, a large branch or the like (for the purpose of this specification "non-crushable object" shall mean an object which cannot be reduced to fragments when subjected to a crushing pressure sufficient to fragment a block of frozen vegetable tissue) accidentally loaded with the block of frozen peat moss. When the presence of such non-crushable object is detected, the overload controller immediately aborts the crushing stroke and reverses the actuator driving the crushing assembly to fully open same. When a fully opened condition is achieved, a secondary actuator is set in motion in order to move the crushing assembly to an unloading position for discharging therefrom the non-crushable object.

As embodied and broadly described herein, the invention also provides a method for fragmenting a block of frozen vegetable tissue, such as peat moss, without causing wide-spread damage to the vegetable tissue at the fiber level, comprising the steps of:

positioning the block of frozen vegetable tissue between a pair of support members, each support member having a lattice-like configuration including a plurality of elongated crossing members defining therebetween discharge apertures; and applying localized pressure to a plurality of discrete areas on the block of frozen vegetable tissue which are in a spaced apart relationship and in registry with respective discharge apertures of the support members, whereby the localized pressure reduces the block of frozen vegetable tissue into fragments which egress the support members through discharge apertures thereof.

DESCRIPTION OF A PREFERRED EMBODIMENT

Referring now to the annexed drawings, the present invention provides an apparatus 10 for fragmenting a block of frozen peat moss material in order to reduce the block into smaller fragments, without creating significant damage to the peat moss fibers.

The apparatus 10 comprises a crushing assembly 12 formed by a pair of jaw members 14 and 16 which are movable with relation to one another to burst into fragments a block of frozen peat moss material under the effect of multiple pressure points applied on the block surface.

Figure 1:
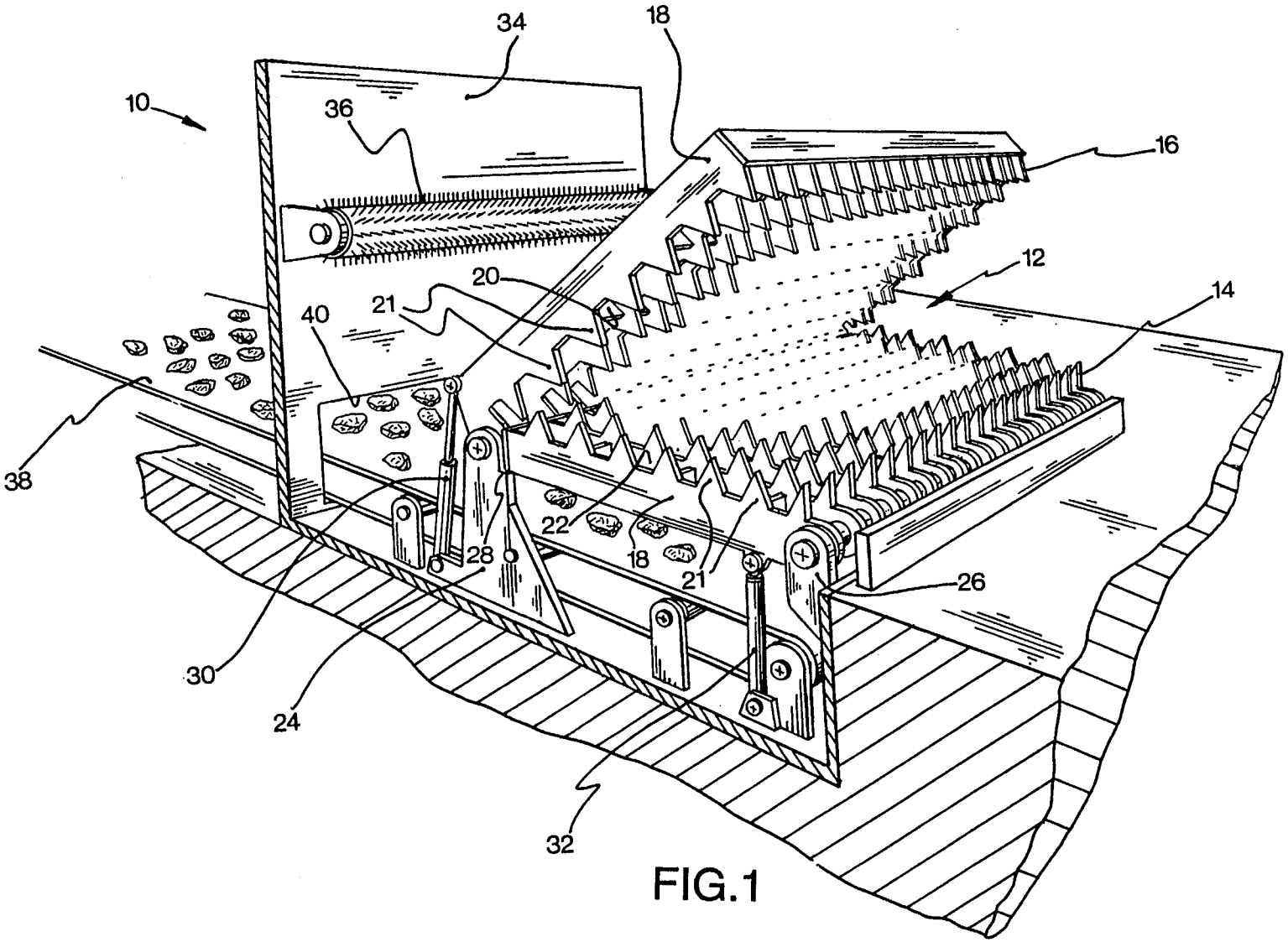
FIG. 1 is a perspective view of an apparatus for fragmenting a block of frozen peat moss material, constructed in accordance with the present invention, some elements of the apparatus being omitted for clarity.
Figure 6:
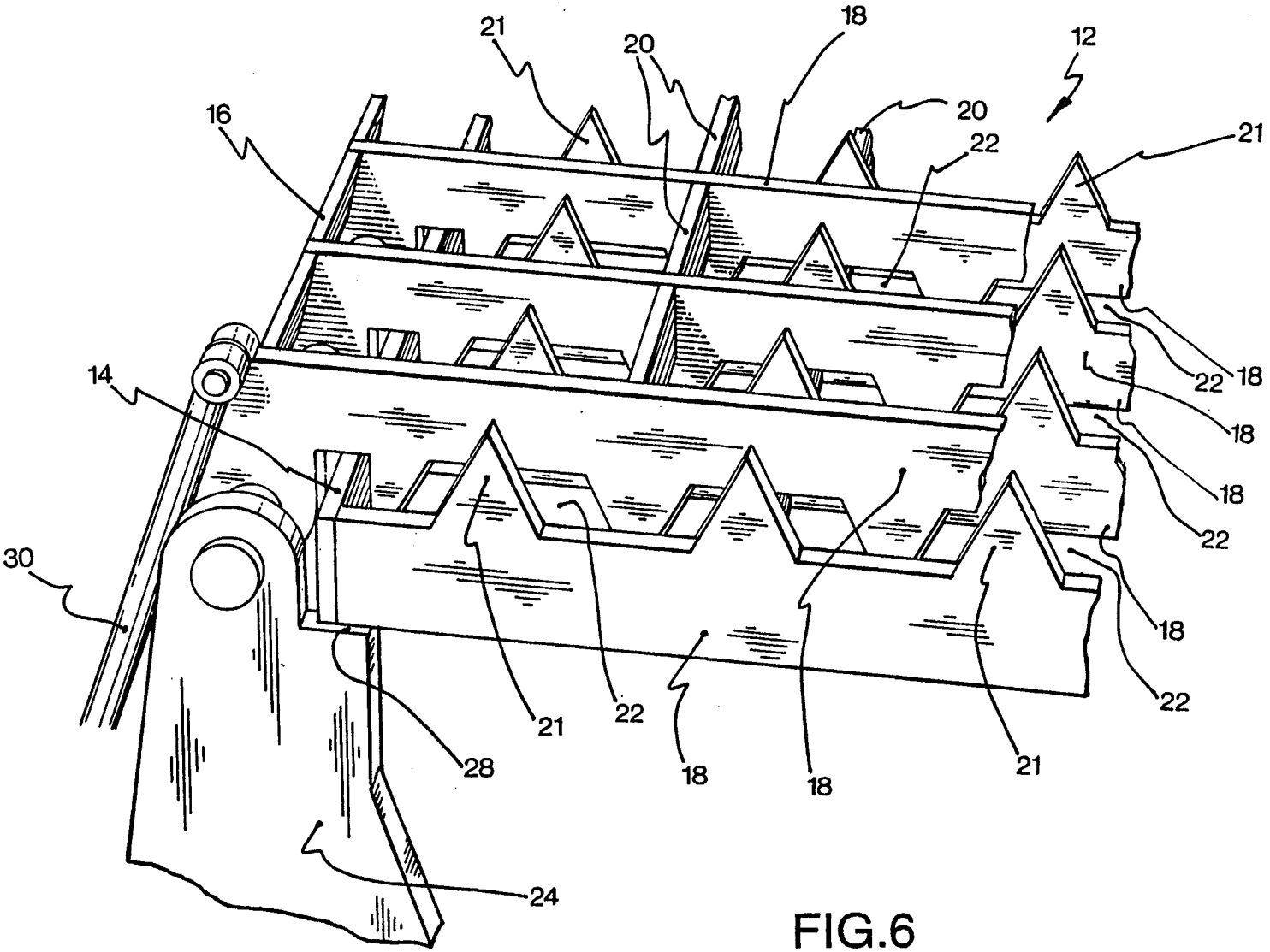
FIG. 6 is an enlarged, perspective fragmentary view of the apparatus according to the invention illustrating in detail the structure of the jaw members and their relationship when the jaw members are in a fully closed position.

As best shown in FIGS. 1 and 6, the jaw member 14 is constituted by an arrangement of thick crossing plates 18 and 20 welded or otherwise attached to each other at their junction points to form a rigid and planar grating. This lattice-like configuration defines a plurality of apertures 22 longitudinally and transversely spaced apart from one another and which are uniformly distributed over the jaw member 14. On the longitudinally extending plates 18 are integrally formed upwardly extending tapered projections 21 constituting crushing teeth. In the example shown, the longitudinal plates 18 are uniformly spaced by a distance of approximately 23 centimeters. The transverse plates 20 are also uniformly spaced and they are disposed at approximately 60 centimeters from one another. The crushing teeth 21 have a height of about 15 centimeters, a longitudinal pitch of about 41 centimeters and a transverse pitch of about 12 centimeters. The resulting bi-dimensional array of crushing teeth has a surface density of about 22 crushing teeth per square meter.

The structure of the jaw member 16 is identical to the jaw member 14.

The jaw members 14 and 16 are transversely offset one relatively to the other, whereby when the crushing assembly is in a fully closed position, as best shown in FIG. 6, the crushing teeth 21 of each jaw member are in registry with respective apertures 22 of the opposite jaw member and penetrate into the apertures. In the mating position, the jaw members are generally horizontal.

Referring back to FIG. 1, the jaw member 16 is pivotally mounted at one transverse extremity to a pair of upwardly extending support arms 24 (only one arm being shown in the drawings). The jaw member 14 is pivotally mounted at one transverse extremity to support arms 26 (only one arm being shown in the drawings) which are remote from the support arms 24. The transverse extremity of the jaw member 14 which is opposite to its pivot axis is supported on shoulders 28 provided in the support arms 24.

To pivot the jaw member 16 with respect to the jaw member 14, a pair of fluid-operated piston-cylinder assemblies 30 (only one being shown in the drawings), such as hydraulic rams, are mounted between the jaw member 16 and the base of the apparatus 10. It will be appreciated that by extending the piston-cylinder assemblies 30, the jaw member 16 pivots toward the jaw member 14. The jaw member 16 pivots away from the jaw member 14 by contracting the piston-cylinder assemblies 30.

For pivoting the jaw member 14 about the support arms 26, hydraulic piston-cylinder assemblies 32 (only one being shown in the drawings) are provided between the jaw member 14 and the base of the apparatus 10. The purpose of this pivotal movement will be described in detail hereinafter.

Although not shown in the drawings, it is to be understood that the hydraulic piston-cylinder assemblies 30 and 32 are connected to a suitable hydraulic circuit supplying thereto pressurized operating fluid. The hydraulic circuit also includes the appropriate valving system for allowing the operator to control the extension and the retraction of the piston-cylinder assemblies 30 and 32.

A vertically extending wall member 34 is mounted immediately behind the support arms 24 and the piston cylinder assemblies 30. On the main surface of the wall member 34 which faces the crushing assembly 12 is rotatably mounted an elongated roll 36 having a plurality of radially projecting prongs. The roll 36 is driven by a motor (not shown in the drawings), either electric or fluid-operated, at the desired speed.

Underneath the crushing assembly 12 is provided an endless conveyor belt 38 of a conventional construction for transporting the fragments of the crushed blocks of frozen peat moss material to a remote location for further processing. To clear a passage for the conveyor belt 38, the wall member 34 is provided with an appropriately dimensioned aperture 40.

Figure 2:
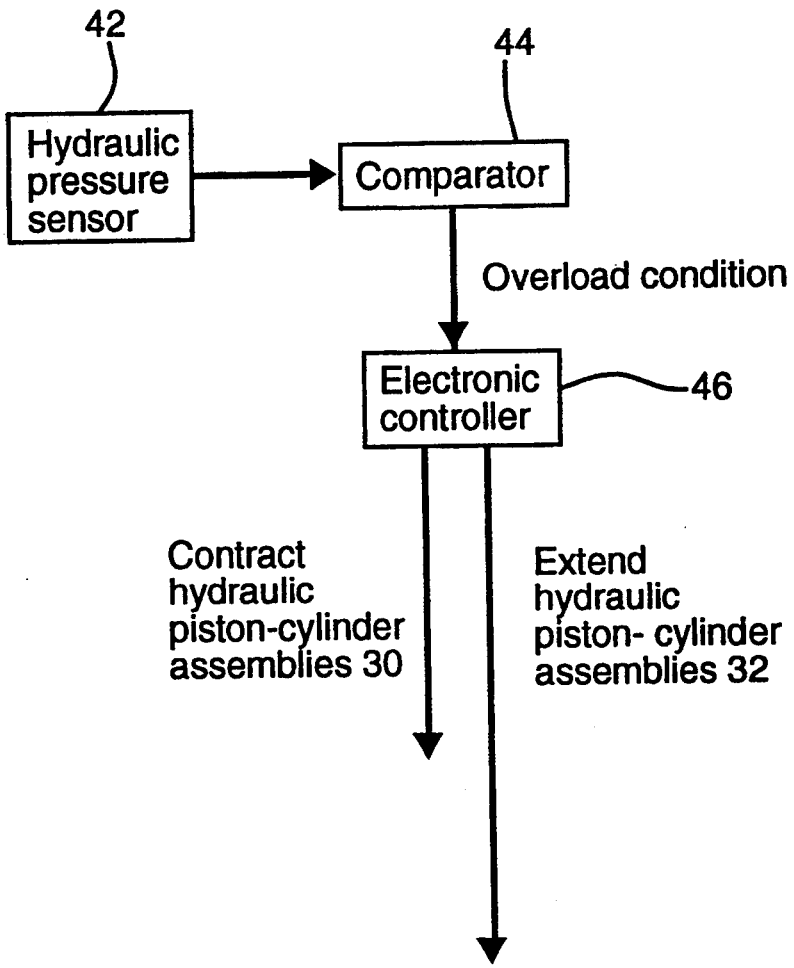
FIG. 2 is a block diagram of an electronic circuit of the apparatus shown in FIG. 1 for sensing an overload condition occurring when a non-crushable object is inadvertently loaded between the jaw members of the apparatus and for actuating the jaw members to discharge the non-crushable object.

Referring now to FIG. 2, the apparatus 10 comprises an electronic circuit which continuously monitors the hydraulic pressure in the piston-cylinder assemblies 30 in order to detect the presence of a non-crushable object such as a rock, a tree trunk or a large branch which may have been accidentally inserted between the jaw members 14 and 16 or contained within the block of frozen peat moss material to be crushed. The electronic circuit comprises a pressure sensor 42 which is mounted into the hydraulic circuit of the piston-cylinder assemblies 30 to continuously monitor the pressure therein. The pressure sensor 42 generates an electric output signal representative of the pressure in the piston-cylinder assemblies 30 which is applied to a comparator circuit 44 continuously comparing the hydraulic pressure with a maximum preset value. When this value is exceeded, the comparator generates an output signal which triggers an electronic controller 46 to abort the crushing stroke and to initiate a discharge cycle by acting on the piston-cylinder assemblies 30 and 32 to unload the non-crushable object from the crushing assembly 12.

It is not deemed necessary to elaborate on the detailed structure of the electronic circuit depicted in FIG. 2, since the construction of this circuit is well within the reach of a man skilled in the art. The circuit may be either hard-wired logic or a software driven, microprocessor based unit, depending upon the specific application.

The operation of the apparatus 10 will now be described in conjunction with FIGS. 3 to 6.

Figure 3:
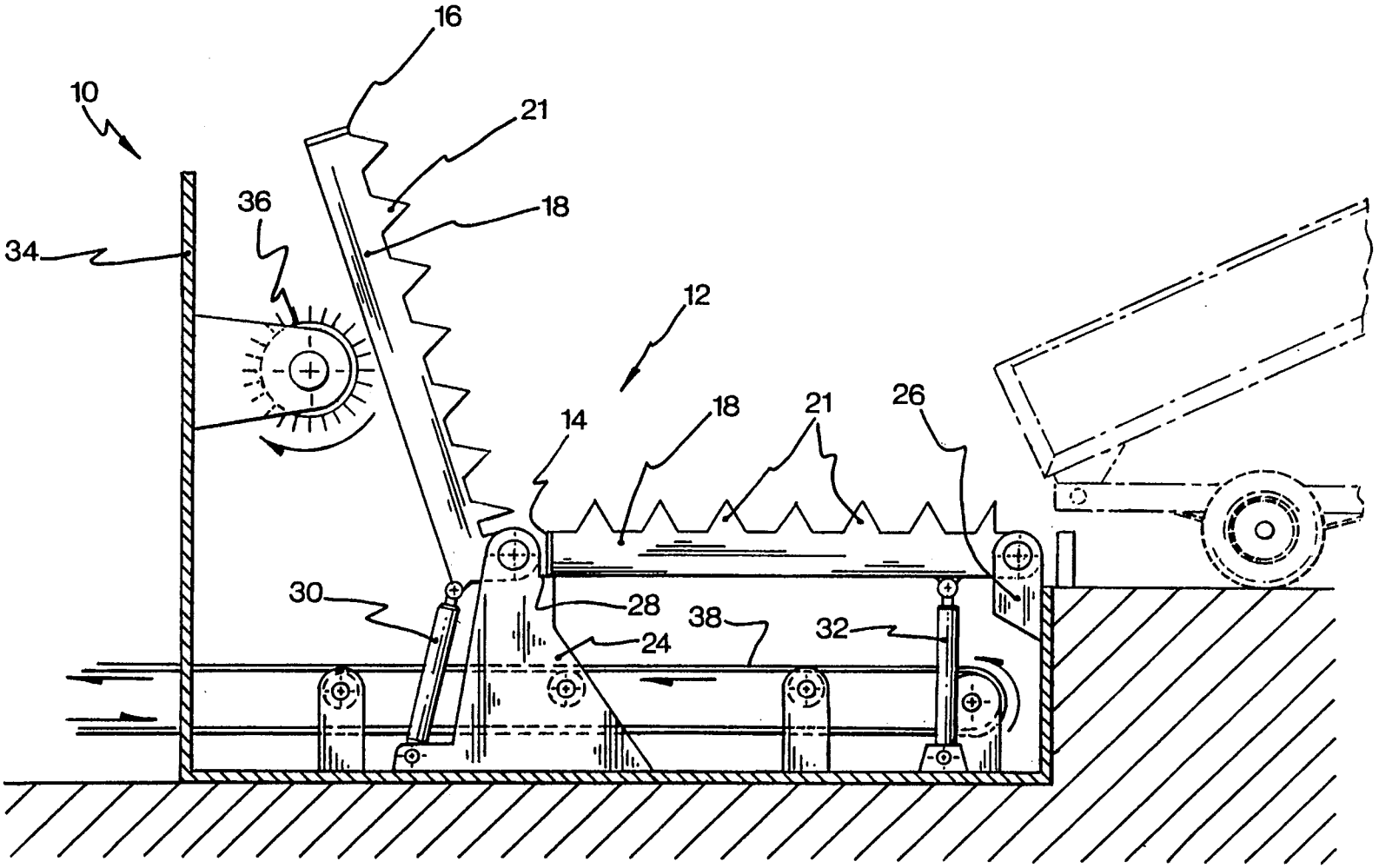
FIG. 3 is a side elevational view of the apparatus shown in FIG. 1, illustrating the jaw members of the apparatus in the opened position.

The block of frozen peat moss material to be processed by the apparatus 10 is delivered by a loader or truck and it is discharged on the jaw member 14 which is in a horizontal position. In the example shown, the dimensions of the block of frozen peat moss material are of approximately 1.20 meters in length, 50 centimeters wide and 50 centimeters high. During the loading operation, the jaw member 16 is maintained in the fully opened position, i.e. at a distance from the jaw member 14 as shown in FIG. 3, to allow the frozen block of peat moss material to be loaded in the crushing assembly 12. Although the drawings illustrate the apparatus 10 processing a single block of frozen peat moss material, in practice a plurality of blocks can be fragmented simultaneously to increase the efficiency of the apparatus 10.

When the loading operation has been completed, the operator actuates the hydraulic piston-cylinder assemblies 30 for closing the crushing assembly 12 by pivoting the jaw member 16 toward the stationary jaw member 14. As a result of this pivotal movement, the crushing teeth 21 of the jaw members which are supporting the block create on its surface intense localized pressure points which are longitudinally and transversely spaced apart from one another and in registry with respective discharge apertures 22. The applied multi-point pressure causes the block to burst into a plurality of smaller fragments. The number of crushing teeth 21 per unit area of a jaw member which determines the concentration of the pressure points on the block surface should not exceed substantially 55 per square meter, otherwise the block of frozen peat moss material may not cleanly crack into fragments, as discussed earlier. In the example shown, each jaw member has approximately 12 crushing teeth per square meter.

Objectively, some fibers of the block are damaged in the process, especially those located at the areas where the block is fractured and separated into fragments, however this fiber damage is isolated and does not significantly affect the absorption properties of the peat moss material.

The fragments which are smaller than the apertures 22 fall under the effect of gravity through the jaw member 14 and are deposited on the conveyor belt 38. The larger fragments are forcibly discharged through the apertures 22 by the crushing teeth 20 which penetrate the respective discharge apertures 22 when the jaw members 14 and 16 are in a mating relationship and overlie one another. This feature is particularly advantageous because it prevents large fragments of peat moss material, especially in a semi-frozen condition, to stick between the jaw members 14 and 16 which may clog the apparatus 10. If clogging occurs, the apparatus 10 must be stopped and manually cleaned which is labour intensive and time consuming.

Figure 4:
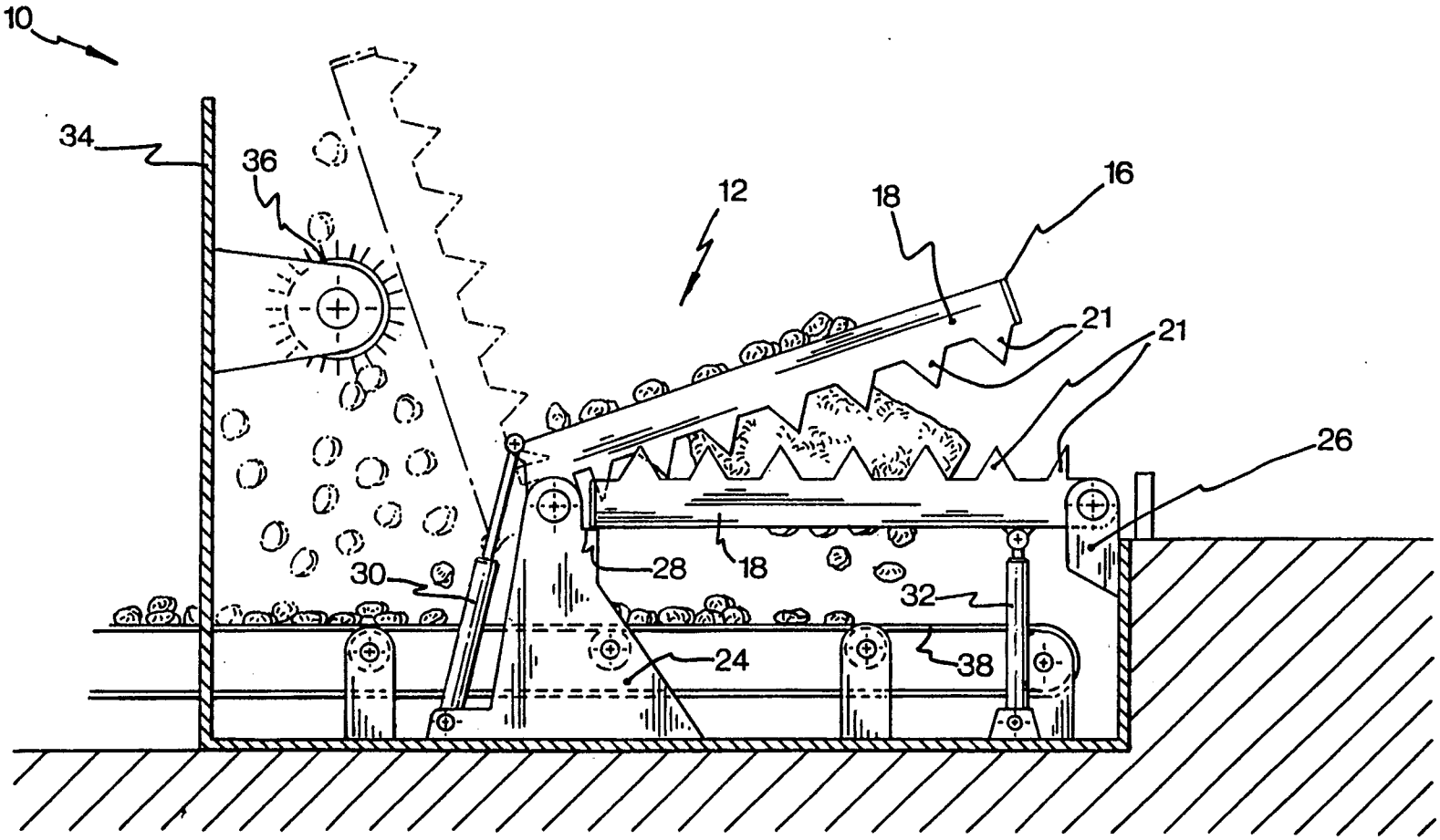
FIG. 4 is a side elevational view of the apparatus shown in FIG. 1, illustrating the jaw members in the closed position.

When the jaw members 14 and 16 have been brought to the fully closed position, the operator of the apparatus 10 contracts the hydraulic piston-cylinder assemblies 30 in order to open the jaw member 16 to allow one or more blocks of frozen peat moss material to be loaded in the crushing assembly 12. As the jaw member 16 pivots backward, the fragments of peat moss material expelled on the top surface of the jaw member 16 fall under the effect of gravity on the conveyor 38. If some fragments stick to the jaw member 16, they are dislodged therefrom by the rotating roll 36 brushing the top surface of the jaw member 16. This feature is best shown in FIG. 4, where the position of the jaw member 16 in the fully opened position is shown in dashed lines.

Figure 5:
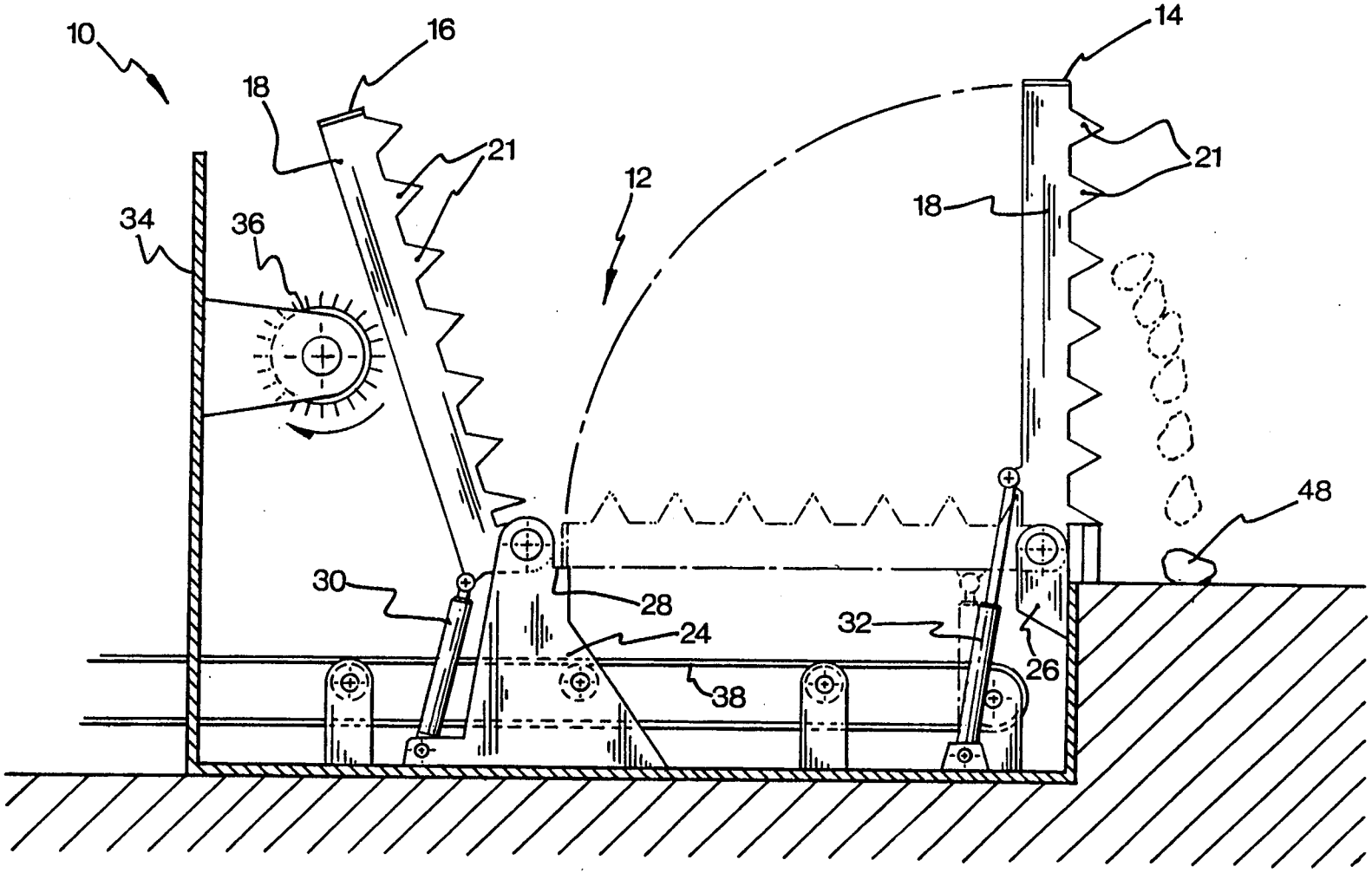
FIG. 5 is a side elevational view of the apparatus shown in FIG. 1, illustrating the sequence of movements executed by the jaw members for discharging from the crushing assembly a non-crushable object inadvertently loaded therein.

With reference to FIG. 5, when a non-crushable object such as a rock 48 is inadvertently loaded between the jaw members 14 and 16 along with the block of frozen peat moss material, the crushing movement of the jaw member 16 will be suddenly interrupted when the crushing teeth 21 engage the rock 48. The resulting increase in the hydraulic pressure in the piston-cylinder assemblies 30 will trip the comparator 44, which will in turn activate the electronic controller 46 in order to initiate a sequence of movements of the jaw members 14 and 16 in order to dislodge the rock 48. The first step is to immediately stop the extension and initiate the retraction of the hydraulic piston-cylinder assemblies 30 to fully raise the jaw member 16 as shown in solid lines in FIG. 5. The second step is to extend the hydraulic piston-cylinder assemblies 32 to raise the jaw member 14 to the upright position, as shown in solid lines, whereby the rock 48 is discharged under the effect of gravity. The hydraulic piston-cylinder assemblies 32 are then retracted to return the jaw member 14 to the horizontal position in which it rests against the shoulders 28 of the support arms 24. The operation of the apparatus 10 may then be resumed.

The scope of the present invention is not limited by the description, examples and suggestive uses herein, as modifications can be made without departing from the spirit of the invention. Thus, it is intended that the present application covers the modifications and variations of this invention provided that they come within the scope of the appended claims and their equivalents.

The embodiments of the invention in which an exclusive property or privilege is claimed are defined as follows:

1. A method for fragmenting a block of frozen vegetable tissue without causing wide-spread damage to the vegetable tissue at a fiber level, comprising the steps of:

loading the block of frozen vegetable tissue between a pair of support members having a plurality of elongated crossing members defining therebetween discharge apertures; and applying localized pressure to a multiplicity of discrete areas of said block of frozen vegetable tissue in registry with discharge apertures of said support members, whereby reducing to fragments said block of frozen vegetable tissue which egress said support members through said discharge apertures.

2. A method as defined in claim 1, comprising the step of engaging said block of frozen vegetable tissue with crushing teeth in a spaced apart relationship for fragmenting the block of frozen vegetable tissue, said crushing teeth being in registry with said discharge apertures.

3. A method as defined in claim 2, comprising the step of driving said crushing teeth into respective discharge apertures of said support members for expelling said fragments therefrom.

4. A method as defined in claim 2, comprising the steps of providing crushing teeth on each support member and moving said support members toward one another to fragment said block of frozen vegetable tissue.

5. A method as defined in claim 4, comprising the step of providing each support member with a number of crushing teeth per square meter which does not exceed substantially 55.

6. A method as defined in claim 4, comprising the step of providing each support member with approximately 12 crushing teeth per square meter.

7. A method as defined in claim 4, comprising the step of maintaining one support member stationary and moving another support member toward said one support member for fragmenting said block of frozen vegetable tissue.

8. A method as defined in claim 4, comprising the steps of closing said support members on the block of frozen vegetable tissue for fragmenting the block of frozen vegetable tissue, said method further comprising the steps of detecting presence of a non-crushable object between said support members and interrupting the closing of said support members on the block of frozen vegetable tissue when the non-crushable object is detected between said support members.

9. A method as defined in claim 4, comprising the steps of closing said support members on the block of frozen vegetable tissue for fragmenting the block of frozen vegetable tissue, said method further comprising the steps of detecting presence of a non-crushable object between said support members and opening said support members when the non-crushable object is detected between said support members.

10. A method as defined in claim 4, comprising the steps of detecting presence of a non-crushable object between said support members and moving a support member toward an unloading position when the non-crushable object is detected between said support members for discharging the non-crushable object therefrom.

11. A method as defined in claim 2, comprising the step of providing said support members with crushing teeth which are longitudinally and transversally spaced apart from one another.

12. A method as defined in claim 1, comprising the steps of:

pivotally mounting a first support member to a first supporting structure;

pivotally mounting a second support member to a second supporting structure, said support members being capable of adopting a mating relationship in which said support members are in adjacency, in said mating relationship said support members being in a generally horizontal position and said first support member overlying said second support member;

providing a first fluid-operated piston-cylinder assembly in a driving relationship with said first support member for pivoting said first support member about said first supporting structure in order to move said first support member toward and away from said second support member;

providing a second fluid-operated piston-cylinder assembly in driving relationship with said second support member for pivoting said second support member about said second supporting structure toward an unloading position;

sensing a pressure of operating fluid in said first fluid-operated piston-cylinder assembly;

comparing the pressure of operating fluid in said first fluid-operated piston-cylinder assembly with a predetermined value representing a maximum allowable pressure in said first fluid-operated piston-cylinder assembly, a non-crushable object between said support members blocking a closing movement of said first support member toward said second support member causing an overload condition in which the pressure of operating fluid in said first fluid-operated piston-cylinder assembly exceeds said predetermined value;

upon occurrence of said overload condition, actuating said first fluid-operated piston-cylinder assembly to move said first support member away from said second support member and actuating said second fluid-operated piston-cylinder assembly to move said second support member toward said unloading position for discharging said non-crushable object from said second support member.

13. An apparatus for fragmenting a block of frozen vegetable tissue without causing wide-spread damage to the vegetable tissue at a fiber level, comprising:

a crushing assembly including a pair of jaw members, each jaw member having a plurality of elongated crossing members defining therebetween discharge apertures, said crushing assembly further including a plurality of projecting crushing teeth in a spaced apart relationship, said crushing assembly being movable between an opened position and a closed position, in said opened position said jaw members being in a spaced apart relationship and capable of accepting therebetween a block of frozen vegetable tissue, in said closed position said jaw members being in a mating relationship wherein said crushing teeth penetrate respective discharge apertures, movement of said crushing assembly from said opened to said closed position causes said crushing teeth to engage and reduce to fragments said block of frozen vegetable tissue which egress said crushing assembly through discharge apertures thereof; and actuating means in driving relationship with said crushing assembly for moving said crushing assembly between said opened and closed positions.

14. An apparatus as defined in claim 13, wherein one of said jaw members is stationary and another of said jaw members moves toward and away from said one jaw member when said crushing assembly moves between said opened and closed positions.

15. An apparatus as defined in claim 14, wherein said another jaw member is capable of pivotal movement with respect to said one jaw member.

16. An apparatus as defined in claim 13, wherein each jaw member includes crushing teeth, in said mating relationship crushing teeth of one jaw member penetrating discharge apertures of an opposite jaw member.

17. An apparatus as defined in claim 16, wherein each jaw member has a number of crushing teeth per square meter which does not exceed substantially 55.

18. An apparatus as defined in claim 16, wherein each jaw member has approximately 12 crushing teeth per square meter.

19. An apparatus as defined in claim 16, wherein each jaw member comprises a plurality of generally parallel plate members, said crushing teeth being mounted on said place members.

20. An apparatus as defined in claim 13, wherein said crushing teeth comprise tapered projections.

21. An apparatus as defining in claim 13, wherein each jaw member comprises crushing teeth which are longitudinally and transversely spaced apart from one another.

22. An apparatus as defined in claim 13, wherein said actuating means includes a fluid-operated piston-cylinder assembly.

23. An apparatus as defined in claim 13, further comprising an electronic circuit for detecting presence of a non-crushable object between said jaw members, said actuating means being responsive to said electronic circuit for interrupting a closing movement of said crushing assembly when a non-crushable object is detected between said jaw members.

24. An apparatus as defined in claim 23, wherein said actuating means is responsive to said electronic circuit for moving said crushing assembly toward said opened position when a non-crushable object is detected between said jaw members.

25. An apparatus as defined in claim 13, further comprising an electronic circuit for detecting the presence of a non-crushable object between said jaw members, said crushing assembly being responsive to said electronic circuit for moving toward an unloading position for discharging from said crushing assembly a non-crushable object detected therein by said electronic circuit.

26. An apparatus as defined in claim 13, further comprising a material conveying device underneath said crushing assembly for receiving said fragments and transporting said fragments to a remote location.

27. An apparatus as defined in claim 26, wherein said material conveying device is an endless conveyor.

28. An apparatus as defined in claim 13, further comprising a rotating roll having a plurality of prongs which engage said crushing assembly for dislodging fragments of vegetable tissue adhering to said crushing assembly.

29. An apparatus as defined in claim 13, comprising:

a first jaw member pivotally mounted to a first supporting structure;

a second jaw member pivotally mounted to a second supporting structure, in said mating relationship said jaw members being in a generally horizontal position and said first jaw member overlying said second jaw member;

a first fluid-operated piston-cylinder assembly in a driving relationship with said first jaw member for pivoting said first jaw member about said first supporting structure in order to move said first jaw member toward and away from said second jaw member;

a second fluid-operated piston-cylinder assembly in driving relationship with said second jaw member for pivoting said second jaw member about said second supporting structure toward an unloading position;

a pressure sensor coupled to said first fluid-operated piston-cylinder assembly for generating a first electric signal representative of a pressure of operating fluid in said first fluid-operated piston-cylinder assembly;

a comparator coupled to said pressure sensor for comparing said first electric signal with a predetermined value representing a maximum allowable fluid pressure, said comparator generating a second electric signal when said first electric signal exceeds said predetermined value, a non-crushable object between said jaw members which is blocking a closing movement of said first jaw member causing said comparator to generate said second electric signal;

an electronic controller coupled to said comparator, said first and second fluid-operated piston-cylinder assemblies being responsive to said electronic controller, upon reception of said second electric signal said electronic controller:

a) actuating said first fluid-operated piston-cylinder assembly to move said first jaw member away from said second jaw member; and b) actuating said second fluid-operated piston-cylinder assembly to move said second jaw member toward said unloading position for discharging said non-crushable object from said second jaw member.

* * * * *